US009534828B2

(12) United States Patent
Kim et al.

(10) Patent No.: US 9,534,828 B2
(45) Date of Patent: Jan. 3, 2017

(54) REFRIGERATOR

(71) Applicant: SAMSUNG ELECTRONICS CO., LTD., Suwon-si (KR)

(72) Inventors: Byoung Mok Kim, Kwangju (KR); Seong Woo Kim, Anyang-si (KR); Yong Bum Seo, Seoul (KR); Seung Yong Yang, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 35 days.

(21) Appl. No.: 14/161,087

(22) Filed: Jan. 22, 2014

(65) Prior Publication Data

US 2014/0203698 A1 Jul. 24, 2014

(30) Foreign Application Priority Data

Jan. 21, 2013 (KR) ..... 10-2013-0006368

(51) Int. Cl.
*F25D 23/02* (2006.01)
*F25D 23/00* (2006.01)
*E05F 7/06* (2006.01)

(52) U.S. Cl.
CPC ..... *F25D 23/028* (2013.01); *E05F 7/06* (2013.01); *F25D 23/00* (2013.01); *F25D 2323/021* (2013.01); *F25D 2323/024* (2013.01)

(58) Field of Classification Search
CPC ..... F25D 23/00; F25D 23/021; F25D 23/024; F25D 23/028; F25D 2323/021; F25D 2323/02; E05D 7/06; E05D 2700/10; E05Y 2700/10; E05Y 2800/404; E05Y 2800/406; E05Y 2900/306; E05Y 2900/31; E05F 7/06

(Continued)

(56) References Cited

U.S. PATENT DOCUMENTS 3,281,992 A * 11/1966 Morrison ..... 49/396
3,612,848 A * 10/1971 Koch et al. ..... 362/92

(Continued)

FOREIGN PATENT DOCUMENTS

CN 1796716 A 7/2006
JP 11-118335 4/1999

(Continued)

OTHER PUBLICATIONS

International Search Report mailed Apr. 1, 2014 in corresponding PCT patent application PCT/KR2014/000521.

(Continued)

*Primary Examiner* — Daniel J Troy
*Assistant Examiner* — Ryan A Doyle
(74) *Attorney, Agent, or Firm* — Staas & Halsey LLP

(57) ABSTRACT

A refrigerator preventing a door thereof from drooping downward and allow the door to be automatically closed. The refrigerator includes a body, a storage compartment provided in the body, a front thereof being open, a door rotatably coupled to the body to open and close the storage compartment, a support unit coupled to a center of a lower portion of the body, the support unit including at least one rotating member arranged to protrude from a front of the body to correspond to a position of the lower portion of the door, and at least one droop prevention unit coupled to the lower portion of the door at a position corresponding to the rotating member, and supported by the rotating member to prevent the door from drooping downward, the droop prevention unit cooperating with the rotating member to support the door in an upward direction when the door is closed.

26 Claims, 17 Drawing Sheets

(58) Field of Classification Search
USPC ..... 312/401, 404–405; 49/396; 292/78
See application file for complete search history.

(56) References Cited

U.S. PATENT DOCUMENTS

| | | | | |
|---|---|---|---|---|
| 4,543,800 | A * | 10/1985 | Mawby et al. | 62/339 |
| 4,590,709 | A * | 5/1986 | Katsman et al. | 49/396 |
| 4,947,583 | A | 8/1990 | Inui et al. | |
| 5,052,151 | A * | 10/1991 | Inui | 49/394 |
| 7,159,278 | B2 * | 1/2007 | Hilger | 16/102 |
| 2005/0218764 | A1 * | 10/2005 | Hong et al. | 312/401 |
| 2013/0328471 | A1 * | 12/2013 | Gore et al. | 312/401 |

FOREIGN PATENT DOCUMENTS

| | | | |
|---|---|---|---|
| JP | 2000-9377 | | 1/2000 |
| JP | 2001349130 | A * | 12/2001 |
| JP | 2004-37008 | | 2/2004 |
| JP | 2011-69612 | | 4/2011 |
| KR | 0113756 | | 1/1994 |
| KR | 1997-0007232 | | 2/1997 |
| KR | 1998-013799 | | 6/1998 |
| KR | 1998-021537 | | 7/1998 |
| KR | 1999-007718 | | 2/1999 |
| KR | 10-2009-0077564 | | 7/2009 |
| WO | WO 2012025382 | A2 * | 3/2012 |
| WO | WO 2014035186 | A1 * | 3/2014 |

OTHER PUBLICATIONS

European Office Action dated Jul. 15, 2016 in corresponding European Patent Application No. 14740833.0.

Chinese Office Action dated Sep. 1, 2016 in corresponding Chinese Patent Application No. 201480005525.2.

Supplementary European Search Report issued Nov. 17, 2016 in corresponding European Patent Application No. 14740833.0 (11 pages).

* cited by examiner

REFRIGERATOR

CROSS-REFERENCE TO RELATED APPLICATIONS

This application claims the benefit of Korean Patent Application No. 10-2013-0006368, filed on Jan. 21, 2013 in the Korean Intellectual Property Office, the disclosure of which is incorporated herein by reference.

BACKGROUND

1. Field

The following description relates to a refrigerator which may prevent a door thereof from drooping downward.

2. Description of the Related Art

A refrigerator, which generally includes a storage compartment and a cool air supply unit to supply cool air to the storage compartment, is an appliance used to keep food fresh.

The storage compartment is maintained with a temperature range required to keep food fresh.

The storage compartment of such a refrigerator is provided with an open front portion. The open front portion is closed by a door to maintain the temperature of the storage compartment.

The storage compartment is divided into left and right compartments, for example, by a partition wall. The refrigeration compartment and the freezer compartment partitioned by the partition wall are rotatably coupled to the body by upper and lower hinges.

The door to open and close the refrigeration compartment and the freezer compartment, is pivotably arranged by fixing one end portion thereof to upper and lower hinges. Therefore, the other end portion of the door which is not fixed by the upper and lower hinges may droop downward after extended use of the refrigerator.

SUMMARY

Therefore, it is an aspect of the present disclosure to provide a refrigerator which may prevent a door thereof from drooping downward and allow the door to be automatically closed.

Additional aspects of the disclosure will be set forth in part in the description which follows and, in part, will be obvious from the description, or may be learned by practice of the disclosure.

In accordance with an aspect of the present disclosure, a refrigerator includes a body, a storage compartment provided in the body, a front thereof being open, a door rotatably coupled to the body to open and close the storage compartment, a support unit coupled to a center of a lower portion of the body, the support unit including at least one rotating member arranged to protrude from a front of the body to correspond to a position of the lower portion of the door, and at least one droop prevention unit coupled to the lower portion of the door at a position corresponding to the rotating member, and supported by the rotating member to prevent the door from drooping downward, the droop prevention unit cooperating with the rotating member to support the door in an upward direction when the door is closed.

The door may include a refrigeration compartment door and a freezer compartment door, wherein the droop prevention unit may be coupled to lower portions of the refrigeration compartment door and the freezer compartment door at positions corresponding to the rotating member.

The rotating members may correspond in number to the droop prevention units.

The support unit may include a frame coupled to the body, the rotating member rotatably coupled to the frame, and a cover to cover an upper portion of the frame.

The frame may include a first frame coupled to a lower portion of the body, and a second frame extending forward from the first frame to be exposed outside of the front of the body, wherein the rotating member may be arranged at the second frame.

The second frame may be provided with a coupling portion to which the rotating member is coupled, wherein a first rotation hole may be provided at positions on the rotating member and the coupling portion corresponding to each other such that the rotating member is coupled, via a first rotation shaft inserted into the first rotation hole, to the coupling portion to be rotatable about the first rotation shaft.

The cover may be arranged to cover an upper portion of the second frame and may be provided with an opening allowing an upper portion of the rotating member to be exposed outside of the cover.

Each of the lower portions of the refrigeration compartment door and the freezer compartment door may be provided with a coupling groove allowing a part of the droop prevention unit to be accommodated therein and coupled.

The droop prevention unit may include a housing, a part of the housing being accommodated in and coupled to the coupling groove, and a support rotatably coupled to the housing.

The housing and the support may be provided with a second rotation hole at positions corresponding to each other such that the support is coupled, by a second rotation shaft inserted into the second rotation hole, to the housing to be rotatable about the second rotation shaft.

An elastic member may be installed at the second rotation shaft to allow the support maintained in a fixed state to slide on the rotating member in a closing direction of the door and rotate along with the rotating member when the support contacts the rotating member.

Force of the support sliding in the closing direction of the door may be transferred to the door when the door is closed and force of the support sliding in an opening directing of the door may be transferred to the door when the door is opened.

A lower portion of the housing may be shaped to be open to allow the support to contact the rotating member.

The support may include a first support provided at a front portion of the second rotation hole into which the second rotation shaft is inserted to contact the rotating member when the door is closed, and a second support provided at a rear portion of the second rotation hole to contact the rotating member and support the door together with the first support when the support rotates along with the rotating member.

In accordance with another aspect of the present disclosure, a refrigerator includes a body, a storage compartment provided in the body, a front thereof being open, a door rotatably coupled to the body to open and close the storage compartment, the door comprising a refrigeration compartment door and a freezer compartment door, a support unit coupled to a lower portion of the body to protrude from a front of the body to support the door, and at least one droop prevention unit coupled to each of lower portions of the refrigeration compartment door and the freezer compartment door to be supported by the support unit to prevent the freezer compartment door and the refrigeration compartment door from drooping downward.

The support unit may be coupled to a center of the lower portion of the body, and may include a frame coupled to the body, a plurality of rotating members rotatably coupled to the frame, and a cover to cover an upper portion of the frame.

The frame may include a first frame coupled to a lower portion of the body, and a second frame extending forward from the first frame to be exposed outside of the front of the body, wherein the rotating members may be arranged at the second frame.

The second frame may be provided with a coupling portion to which the rotating members are coupled, wherein a first rotation hole may be provided at positions on the rotating members and the coupling portion corresponding to each other such that the rotating members are coupled, via a first rotation shaft inserted into the first rotation hole, to the coupling portion to be rotatable about the first rotation shaft.

The cover may be arranged to cover an upper portion of the second frame, and may be provided with an opening allowing upper portions of the rotating members to be exposed outside of the cover.

Each of the lower portions of the refrigeration compartment door and the freezer compartment door may be provided with a coupling groove allowing a part of the droop prevention unit to be accommodated therein and coupled.

The droop prevention unit may include a housing, a part of the housing being accommodated in and coupled to the coupling groove, and a support rotatably coupled to the housing and supported by the rotating members.

The housing and the support may be provided with a second rotation hole at positions corresponding to each other such that the support is coupled, via a second rotation shaft inserted into the second rotation hole, to the housing to be rotatable about the second rotation shaft.

An elastic member may be installed at the second rotation shaft to allow the support maintained in a fixed state to slide on the rotating member in a closing direction of the refrigeration compartment door and the freezer compartment door and rotate along with the rotating member when the support contacts the rotating member.

Force of the support sliding in the closing direction of the door may be transferred to the door when the door is closed and force of the support sliding in an opening directing of the door may be transferred to the door when the door is opened.

A lower portion of the housing may be shaped to be open to allow the support to contact the rotating members.

The support may include a first support provided at a front portion of the second rotation hole into which the second rotation shaft is inserted to contact the rotating members when the door is closed, and a second support provided at a rear portion of the second rotation hole to contact the rotating members and support the door together with the first support when the support rotates along with the rotating members.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
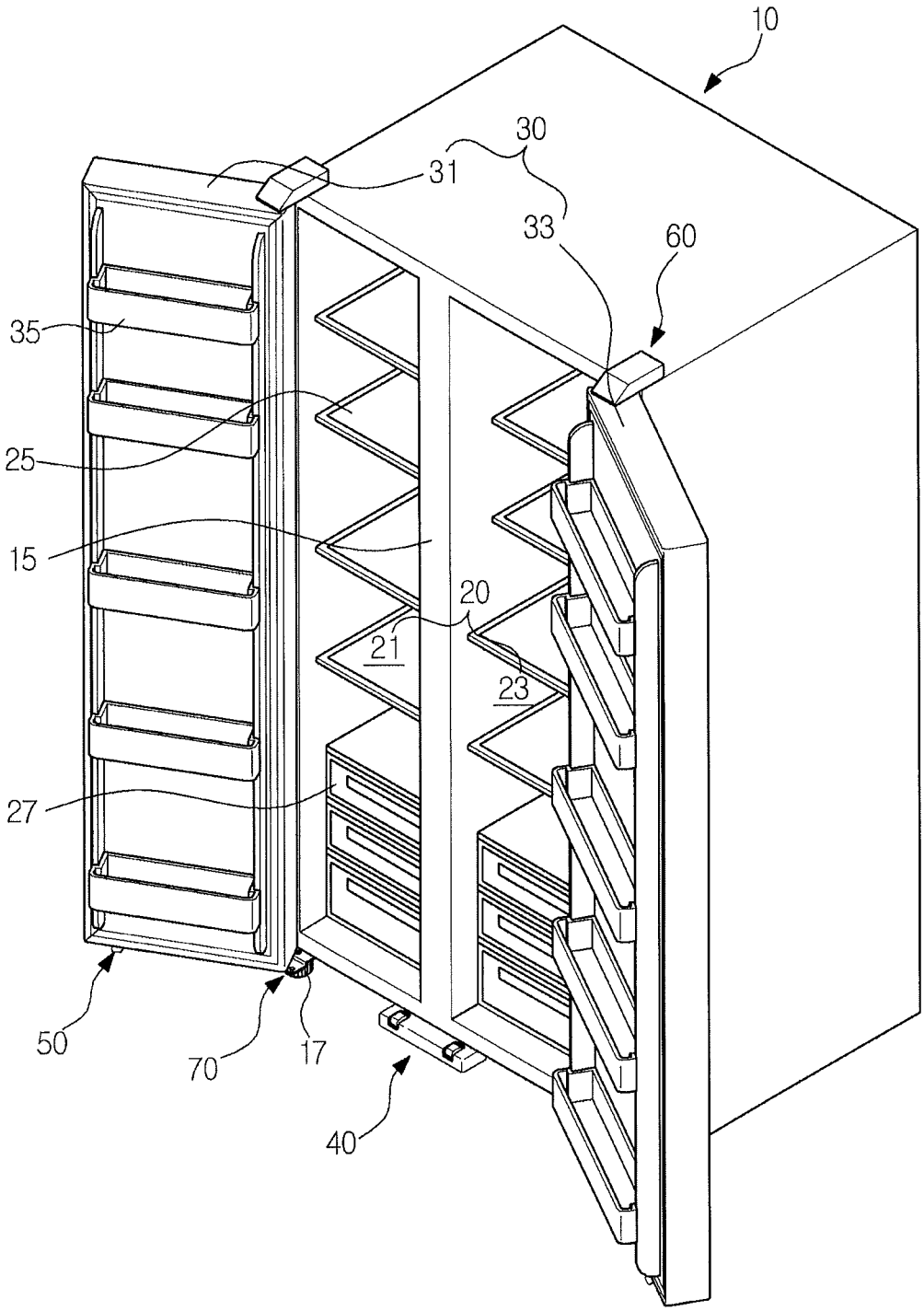
FIG. 1 is a perspective view showing a refrigerator according to an exemplary embodiment of the present disclosure.

Reference will now be made in detail to embodiments of the present disclosure, examples of which are illustrated in the accompanying drawings, wherein like reference numerals refer to like components throughout.

Figure 2:
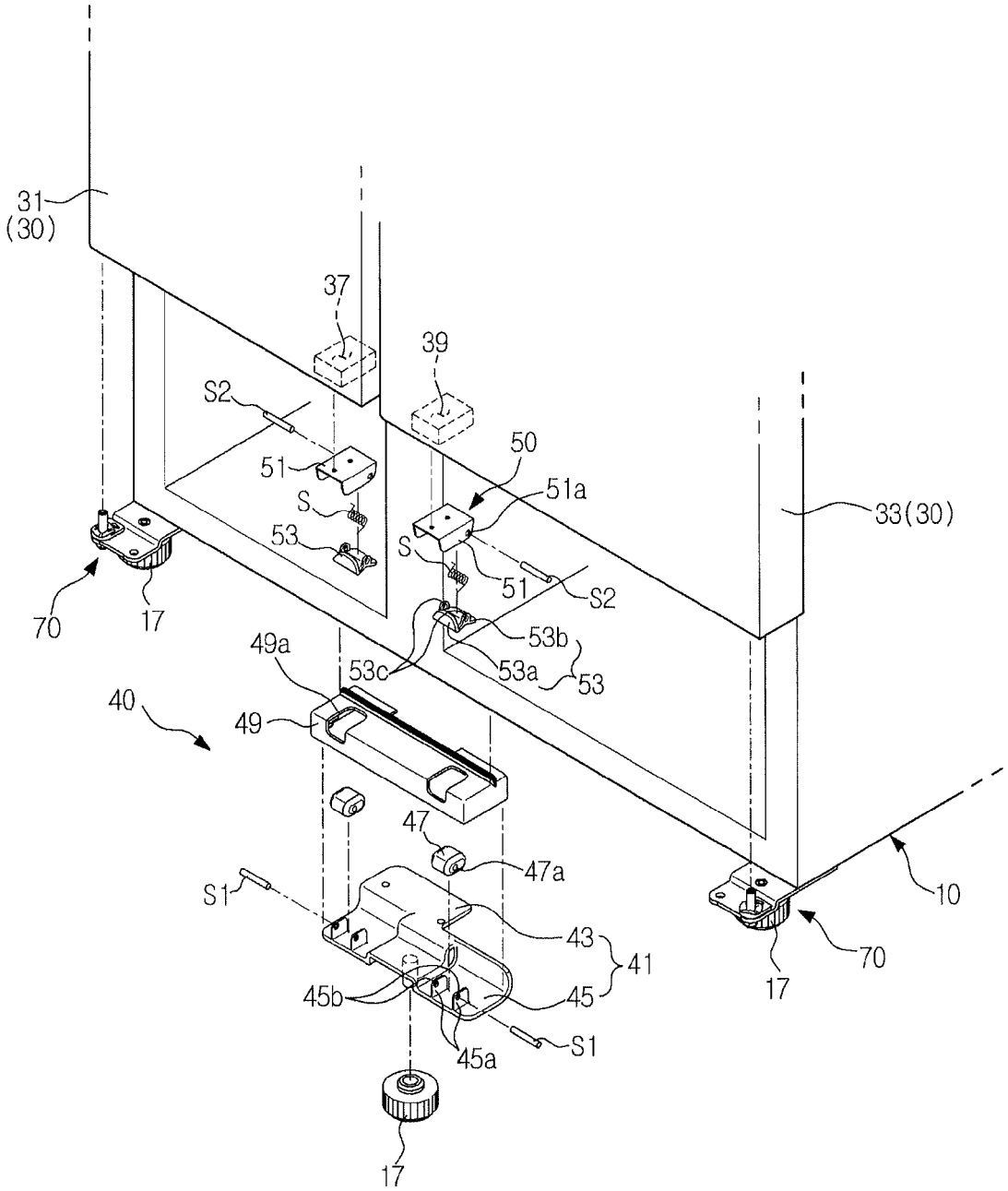
FIG. 2 is an exploded view showing a support unit and a droop prevention unit respectively coupled to the lower portions of a body and a door according to the illustrated embodiment.

As shown in FIGS. 1 and 2, a refrigerator includes a body 10, a storage compartment 20 arranged in the body 10 such that an open front portion is formed thereof, a door 30 rotatably coupled to the body 10 to open and close the storage compartment 20, a support unit 40 coupled to a lower portion of the body 10 and protruded from the front portion of the body 10 to support the door 30, and a droop prevention unit 50 coupled to a lower portion of the door 30 to be supported by the support unit 40 and to prevent the door 30 from drooping downward.

The body 10 includes an inner case 11 to form the storage compartment 20, an outer case 13 to form an external appearance of the body 10, a cool air supply unit (not shown) to supply cool air to the storage compartment 20, a partition wall 15 to divide the storage compartment 20 into left and right sections, and a prop member 17 to support the body 10.

The prop member 17 to support the body 10 may be coupled to the lower rear portion of the body 10, the lower portion of the support unit 40, and the lower portion of a lower hinge 70 coupled to the lower front portion of the body 10, which will be described later.

The cool air supply unit may include a compressor, a condenser, an expansion valve, an evaporator, a fan, and a cool air duct. Thermal insulation 19 is formed between the inner case 11 and the outer case 13 of the body 10 through a foaming process to preserve the cool state of the storage compartment 20.

A machine room (not shown), in which the compressor to compress a refrigerant and the condenser to condense the compressed refrigerant are installed, is provided at the lower part of the rear portion of the body 10.

The storage compartment 20 is divided into left and right sections by the partition wall 11. A refrigeration compartment 21 is arranged at the right portion of the body 10, and a freezer compartment 23 is arranged at the left portion of the body 10.

While the refrigeration compartment 21 and the freezer compartment 23 are illustrated as being arranged respectively at the right portion and left portion of the body 10 divided by the partition wall 11, the freezer compartment 23 may be arranged at the right portion of the body 10 and the refrigeration compartment 21 may be arranged at the left portion thereof.

The storage compartment 20 may be provided with a plurality of shelves 25 to divide the inside of the storage compartment 20 including the refrigeration compartment 21 and the freezer compartment 23 into a plurality of sections. A plurality of storage vessels 27 to store food may be disposed at the lower portion of the storage compartment 20.

While each of the refrigeration compartment 21 and the freezer compartment 23 are illustrated as having a plurality of shelves 25 and a plurality of storage vessels 27, only one of the refrigeration compartment 21 or the freezer compartment 23 may alternatively be provided with a plurality of shelves 25 and storage vessels 27.

The refrigeration compartment 21 and the freezer compartment 23 are respectively opened and closed by a refrigeration compartment door 31 and a freezer compartment door 33 pivotably coupled to the body 10. To allow the refrigeration compartment door 31 and the freezer compartment door 33 to be rotatably coupled to the body 10, an upper hinge 60 and a lower hinge 70 are respectively joined to the upper and lower portions of the body 10.

The rear portion of each of the refrigeration compartment door 31 and the freezer compartment door 33 is provided with a plurality of door guides 35 to store food. The lower portions of the refrigeration compartment door 31 and the freezer compartment door 33 are respectively provided with coupling grooves 37 and 39 to which the droop prevention unit 50, which will be described below, is coupled.

While the door guides 35 are illustrated as being provided to the rear portion of the refrigeration compartment door 31 and the freezer compartment door 33, only one of the refrigeration compartment door 31 or the freezer compartment door 33 may be provided with the plurality of door guides 35.

As shown in FIGS. 1 and 2, the support unit 40 to support the lower portion of the door 30 is provided at the center of the lower portion of the body 10 to prevent the door 30 from drooping downward.

The support unit 40 includes a frame 41 coupled to the lower portion of the body 10, a plurality of rotating members 47 rotatably coupled to the frame 41 and a cover 49 to cover the upper portion of the frame 41.

The frame 41 includes a first frame 43 coupled to the lower portion of the body 10, and a second frame 45 extending forward from the first frame 43 to be exposed to the outside of the front portion of the body 10.

The second frame 45 is adapted to protrude from the front portion of the body 10 to correspond to the position of the lower portion of the door 30. The rotating member 47 coupled to the second frame 45 supports the lower portion of the door 30 to prevent the door 30 from drooping downward.

A coupling portion 45*a* to which the rotating member 47 is coupled is provided at the upper portion of the second frame 45. To provide a space allowing the rotating member 47 to be accommodated and coupled therein, the second frame 45 is arranged lower than the first frame 43 by the space in which the rotating member 47 is accommodated.

Two rotatable members 47 are provided to respectively support the refrigeration compartment door 31 and the freezer compartment door 33. The number of the provided coupling portions 45*a*, to which the rotating member 47 are coupled, also corresponds to that of the rotatable members 47. Although as a non-limiting example, two rotatable members and two corresponding coupling portions are shown in FIG. 2, the number of rotatable members and the coupling portions is not limited thereto. For example, a single or three or more rotatable members and corresponding coupling portions may be provided to support the door 30.

The coupling portion 45*a* and the rotating member 47 coupled to the coupling portion 45*a* are provided with first rotation holes 45*b* and 47*a* at positions thereof corresponding to each other. The rotating member 47 is coupled to the coupling portion 45*a* by a first rotation shaft S1 penetrating the first rotation hole 45*b* provided in the coupling portion 45*a* and the first rotation hole 47*a* provided in the rotating member 47 such that the rotating member 47 is rotatable about the first rotation shaft S1.

The rotating member 47 supports the droop prevention unit 50 coupled to the lower portion of the door 30, which will be described later, to prevent the door 30 from drooping downward. When the door 30 is closed, the rotating member 47 contacts a support 53 of the droop prevention unit 50 to be rotatable about the first rotation shaft S1 in a direction in which the door 30 is closed.

Rotation of the rotating member 47 causes the support 53 of the droop prevention unit 50 to slide and rotate on the rotating member 47. The door 30 is automatically closed by the support 53 rotating together with the rotating member 47, which will be described below.

The cover 49 is arranged to cover the upper portion of the second frame 45. An opening 49*a* is provided at the cover 49 to allow the upper portions of the rotating members 47 to be exposed to the outside of the cover 49.

The upper portions of the rotating members 47 are exposed to the outside through the opening 49*a* to contact the support 53 of the droop prevention unit 50.

The droop prevention unit 50 is respectively coupled to the lower portions of the refrigeration compartment door 31 and the freezer compartment door 33. To prevent the refrigeration compartment door 31 and the freezer compartment door 33 from drooping, the droop prevention unit 50 is coupled to end portion of the refrigeration compartment door 31 and the freezer compartment door 33 opposite to the end portion thereof to which the lower hinges 70 are coupled.

This serves to prevent drooping of the end portion of the refrigeration compartment door 31 and the freezer compartment door 33, which do not have supports, in contrast with the portions of the refrigeration compartment door 31 and the freezer compartment door 33 coupled to and supported by the lower hinges 70 and thus may droop after extended use of the refrigerator.

To allow the droop prevention unit 50 to be coupled to the refrigeration compartment door 31 and the freezer compartment door 33, the lower portions of the refrigeration compartment door 31 and the freezer compartment door 33 are respectively provided with the coupling grooves 37 and 39. The coupling grooves 37 and 39 are arranged such that part of the droop prevention units 50 may be accommodated and coupled therein.

The droop prevention unit 50 includes a housing 51 having a portion accommodated in and coupled to the coupling grooves 37 and 39, and the support 53 rotatably coupled to the housing 51.

The lower portion of the housing 51 is shaped to be open to allow the support 53 to contact the rotating member 47 and rotate.

Second rotation holes 51*a* and 53*c* are provided at positions of the housing 51 and the support 53 corresponding to each other. The support 53 is coupled to the housing 51 by a second rotation shaft S2 penetrating through the second rotation hole 51*a* provided in the housing 51 and the second rotation hole 53*c* provided in the support 53 such that the support 53 is rotatable about the second rotation shaft S2.

An elastic member, for example, a spring S is installed at the second rotation shaft S2 to allow the support 53 to remain immovable before contacting the rotating member 47 and to slide and rotate on the rotating member 47 by cooperating with the rotating member 47 only when it contacts the rotating member 47.

When the door 30 is closed, the force produced by sliding of the support 53 which cooperates with the rotating member 47 is transferred to the door 30 in the closing direction of the door 30, thereby automatically closing the door 30. When the door 30 is opened, the force produced by sliding of the support 53 the door 30 is transferred to the door 30 in the direction of opening of the door 30, thereby allowing the door 30 to be easily opened.

The support 53 includes a first support 53*a* provided at the front portion of the second rotation hole 53*c* into which the second rotation shaft S2 is inserted to contact the rotating member 47 when the door 30 is closed, and a second support 53*b* provided at the rear portion of the second rotation hole 53*c* to contact the rotating member 47 and support the door 30 together with the first support 53*a* when the support 53 rotates together with the rotating member 47.

When the door 30 is closed, the first support 53*a* first contacts the rotating member 47 and moves upward by rotating about the second rotation shaft S2. In addition, as the first support 53*a* slides on the rotating member 47 in the direction in which the door 30 is closed and moves upward by rotating about the second rotation shaft S2 while contacting the rotating member 47, the second support 53*b* moves downward by rotating about the second rotation shaft S2, thereby contacting the rotating member 47.

Once the door 30 is completely closed, the first support 53*a* and the second support 53*b* are supported by the rotating member 47, and thereby the door 30 is prevented from drooping downward.

While the support unit 40 and the droop prevention unit 50 are illustrated as being respectively coupled to the lower portion of the body 10 and the lower portion of the door 30, the support unit 40 including the rotating member 47 may be coupled to the lower portion of the door 30, and the droop prevention unit 50 including the support 53 may be coupled to the lower portion of the body 10.

Hereinafter, a description will be given of supporting of the droop prevention unit 50 through the support unit 40 during closing of the door 30 to prevent the door 30 from drooping downward and automatic closing of the door 30, with reference to FIGS. 3 to 5.

Figure 3:
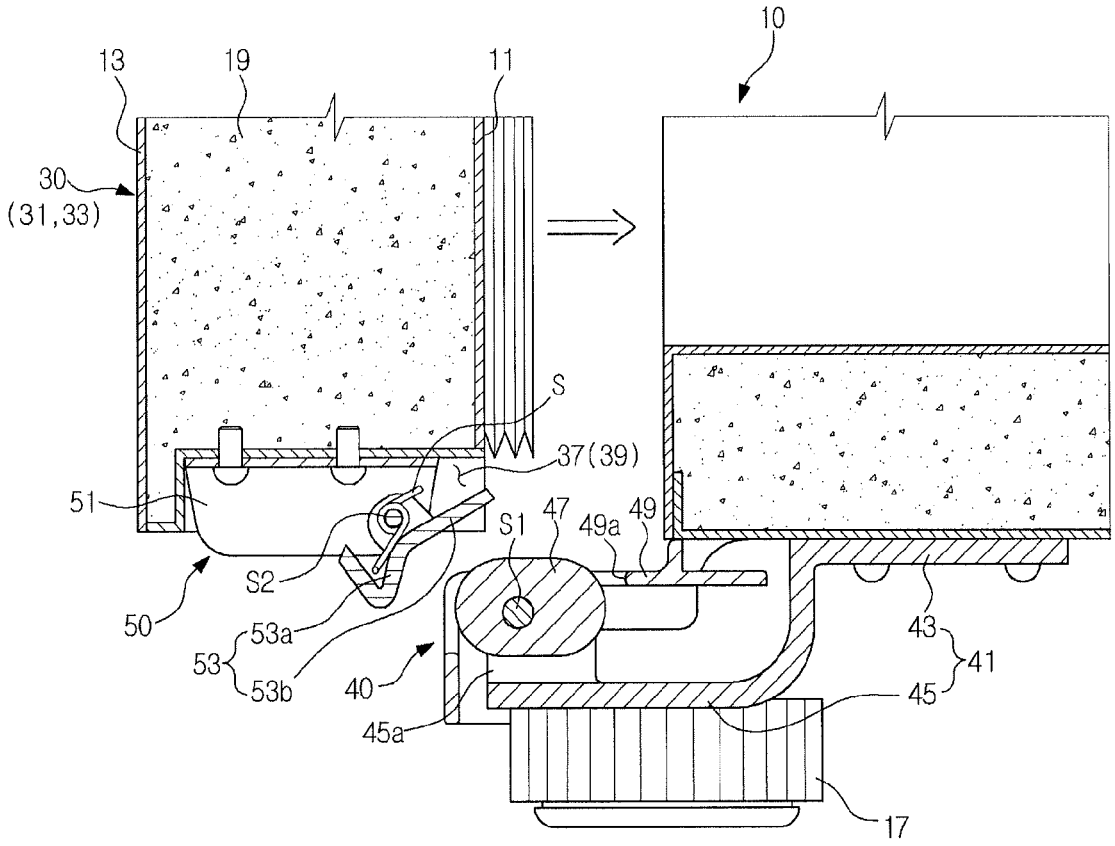
FIGS. 3 to 5 are views illustrating the door supported by the support unit and automatically closed during closing operation of the door according to the illustrated embodiment.
Figure 4:
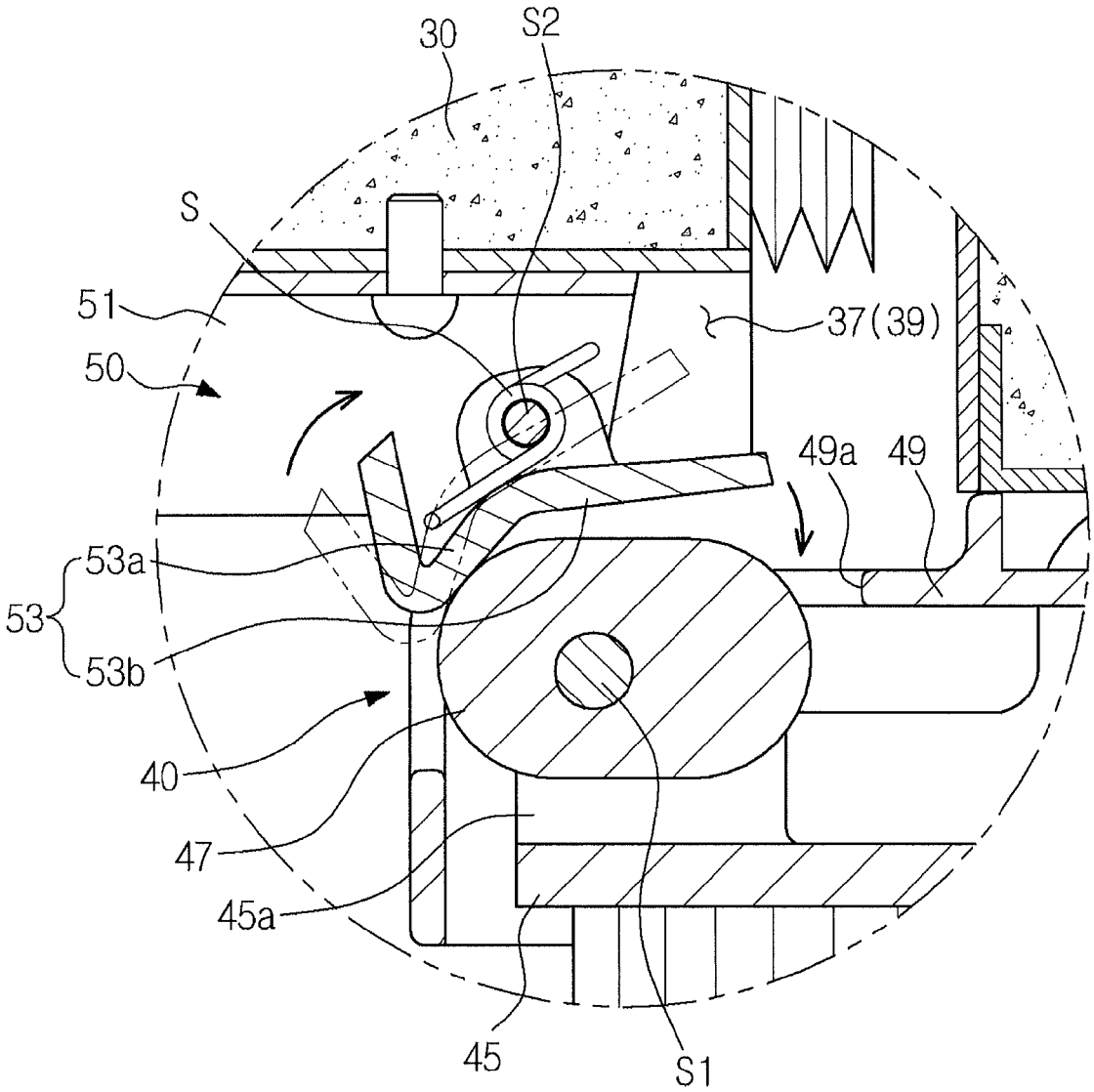

When the open door 30 is closed as shown in FIG. 3, the first support 53*a* of the droop prevention unit 50 coupled to the lower portion of the door 30 comes into contact with the rotating member 47 of the support unit 40 coupled to the lower portion of the body 10 during the operation of closing the door 30, as shown in FIG. 4.

Once the first support 53*a* contacts the rotating member 47, the door 30 continues to move in the closing direction, and therefore the support 53 slides on the rotating member 47 in the closing direction of the door 30 with the first support 53*a* in contact with the rotating member 47, rotating clockwise about the second rotation shaft S2.

Since the rotating member 47 is in contact with the first support 53*a*, the rotating member 47 also rotates clockwise about the first rotation shaft S1.

Figure 5:
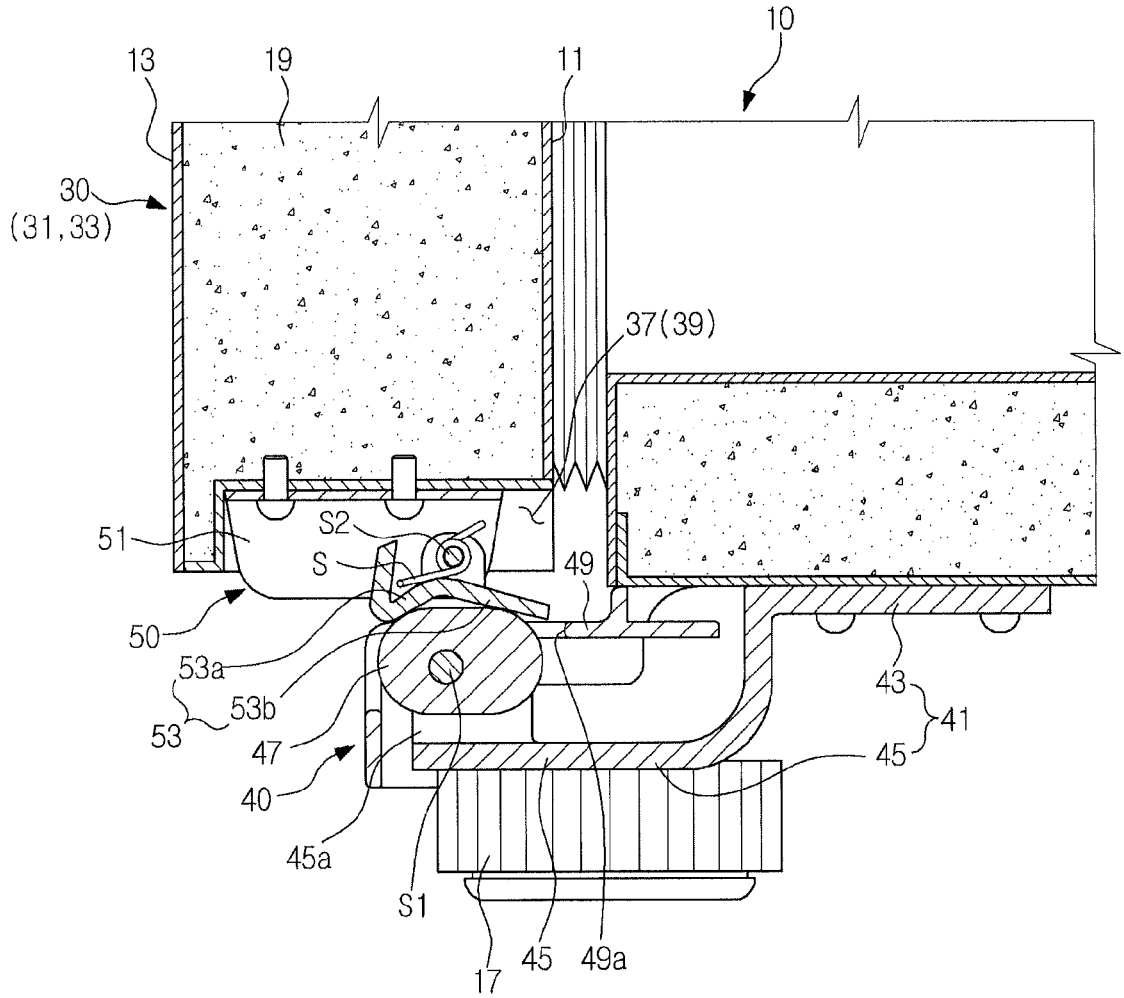

Since the support 53 rotates clockwise about the second rotation shaft S2, the second support 53*b* also comes into contact with the rotating member 47 when the door 30 is completely closed, as shown in FIG. 5.

Once the door 30 is completely closed, the first support 53*a* and the second support 53*b* are both supported by the rotating member 47, and thus the door 30 may move upward a distance corresponding to the amount of drooping, for example. Accordingly, the door 30 drooping downward due to the weight of the door, is returned to and maintained at the horizontal position when the door 30 is closed, and thereby exterior aesthetics and sealing of the door 30 may be improved.

In addition, as shown in FIGS. 4 and 5, since the rotating member 47 rotates clockwise about the first rotation shaft S1 with the first support 53*a* in contact with the rotating member 47 during closing of the door 30, the force of the support 53 sliding on the rotating member 47 in the closing direction of the door 30 while contacting the rotating member 47 is transferred to the door 30 in the closing direction of the door 30, causing automatic closing of the door 30.

A support unit and a droop prevention unit to prevent drooping of a door and allow automatic closing of the door according to another embodiment of the present disclosure will now be described with reference to FIG. 1 and FIGS. 6 to 17.

A detailed description of components identical to those of the support unit 40 and the droop prevention unit 50 shown in FIGS. 1 to 5 will be omitted.

Figure 6:
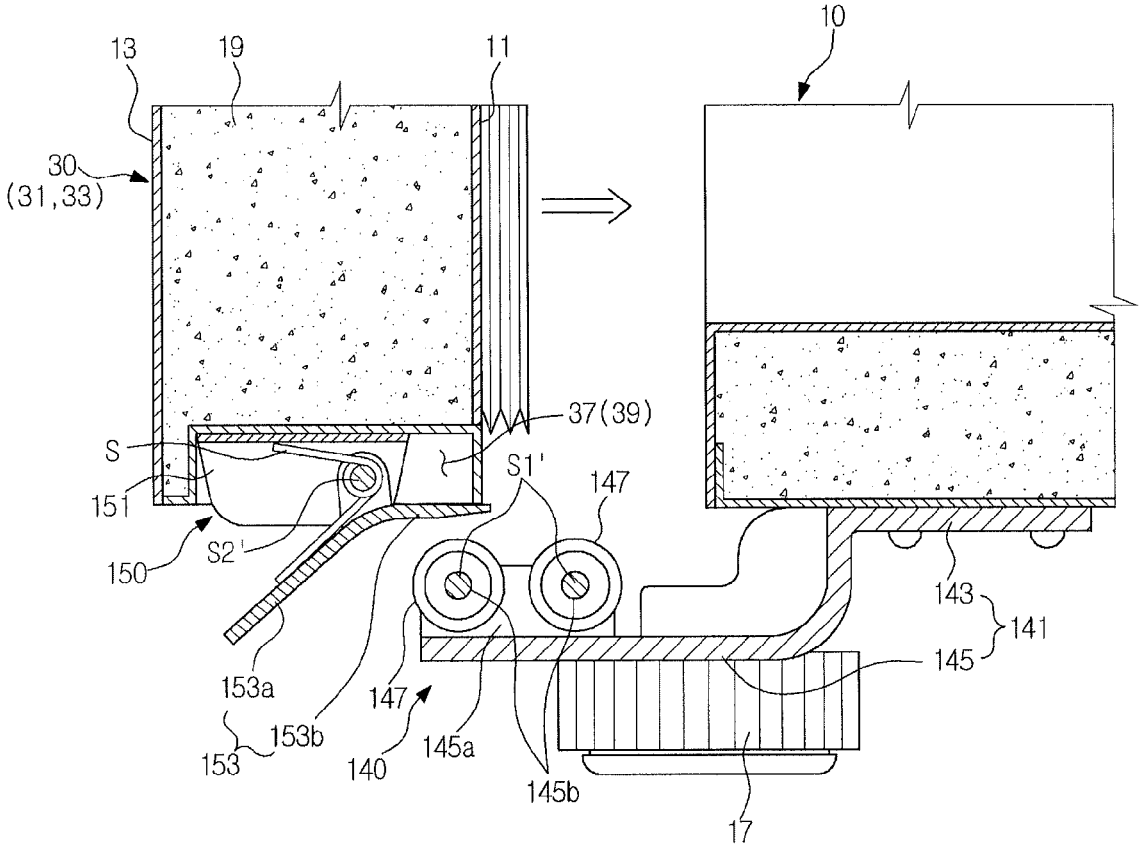
FIGS. 6 to 8 are views illustrating a door supported by a support unit and automatically closed during closing operation of the door according to another embodiment of the present disclosure.
Figure 7:
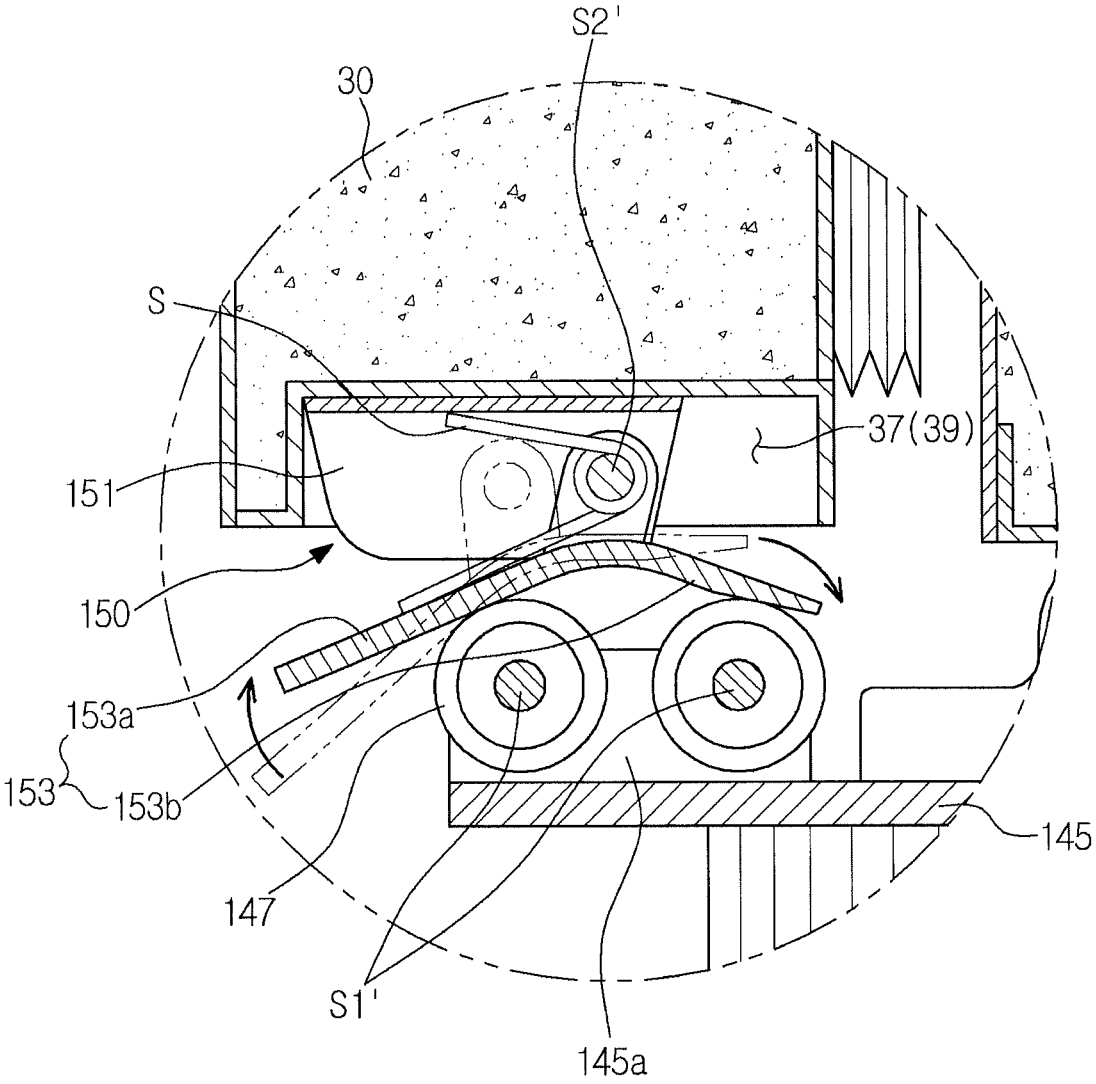
Figure 8:
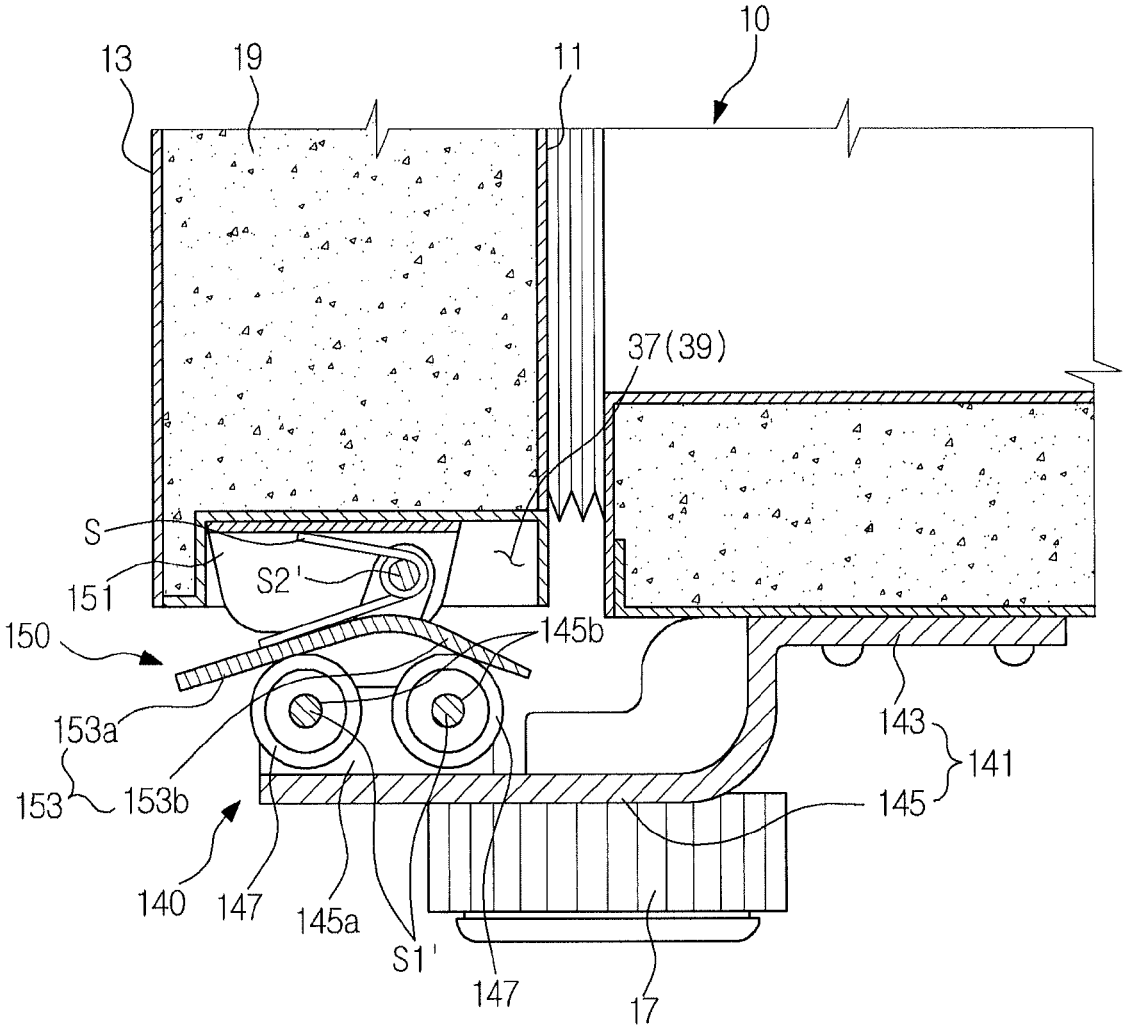

As shown in FIGS. 6 to 8, a support unit 140 coupled to the lower portion of the body 10 may be provided with rotating members 147 configured with a plurality of rollers. The support unit 140 includes a frame 141 coupled to the lower portion of the body 10, a plurality of rotating members 147 rotatably coupled to the frame 141. The frame 141 includes a first frame 143 coupled to the lower portion of the body 10, and a second frame 145 extending forward from the first frame 143 to be exposed to the outside of the front portion of the body 10. A cover (not shown) may be optionally provided. A droop prevention unit 150 coupled to the lower portion of the door 30 includes a housing 151 and a support 153 rotatably coupled to the housing 151.

Since the rotating members 147 are configured with the rollers, a second frame 145 of a frame 141 to which the rotating members 147 are coupled is provided with first rotation holes 145*b* the number of which corresponds to that of the rollers. Each of the rollers is coupled to a coupling portion 145*a* of the second frame 145 by a first rotation shaft S1' such that each of the rollers is rotatable about the first rotation shaft S1'.

The droop prevention unit 150 has the same components as those of the droop prevention unit 50 shown in FIGS. 1 to 5, except that the support 153 is shaped to be supported by all the rotating members 147 which are configured with a plurality of rollers.

As the door 30 is closed, the droop prevention unit 150 is supported by the support unit 140, and thereby the door 30 is prevented from drooping downward. Automatic closing of the door 30 is performed as follows. When the door 30, which is in the open state, is closed as shown in FIG. 6, a first support 153*a* of the droop prevention unit 150 coupled to the lower portion of the door 30 comes into contact with the rotating members 147 of the support unit 140 coupled to the lower portion of the body 10 in the process of closing the door 30, as shown in FIG. 7.

Once the first support 153*a* contacts the rotating members 147, the support 153 slides on the rotating member 147 in the closing direction of the door 30 with the first support 153*a* in contact with the rotating members 147, rotating clockwise about a second rotation shaft S2'.

Since the rotating members 147 configured with a plurality of rollers are in contact with the first support 153*a*, the rotating members 147 also rotate clockwise about the first rotation shafts S1'.

Since the support 153 rotates clockwise about the second rotation shaft S2', a second support 153*b* also comes into contact with the rotating members 147 when the door 30 is completely closed, as shown in FIG. 8.

Once the door 30 is completely closed, the first support 153*a* and the second support 153*b* are both supported by the rotating members 147, and thus the door 30 moves upward by the distance of droop. Accordingly, the door 30 drooping downward due to load is returned to and maintained in the horizontal position when the door 30 is closed, and thereby exterior aesthetics and sealing of the door 30 may be improved.

In addition, as shown in FIGS. 7 and 8, since the rotating members 147 rotate clockwise about the first rotation shafts S1' with the first support 153*a* in contact with the rotating members 147 during closing of the door 30, the force of the support 153 sliding on the rotating members 147 in the closing direction of the door 30 while contacting the rotating members 147 is transferred to the door 30 in the closing direction of the door 30, causing automatic closing of the door 30.

Figure 9:
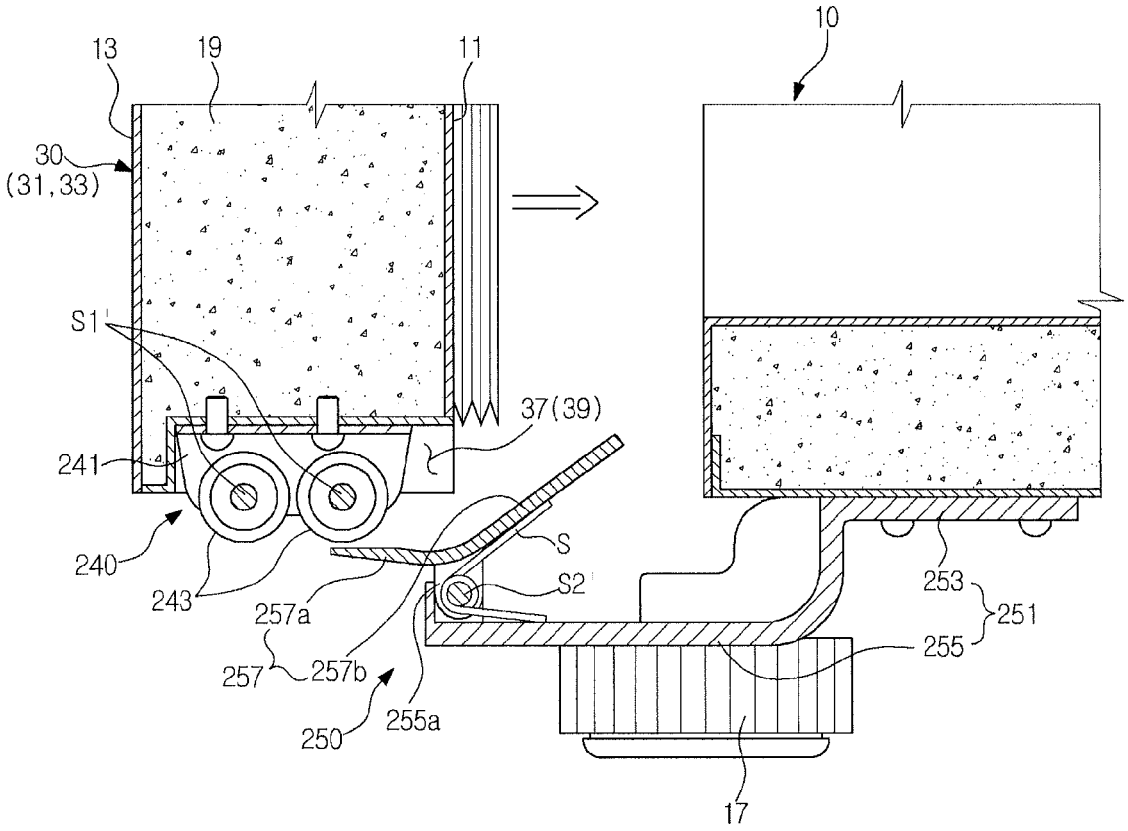
FIGS. 9 to 11 are views illustrating a door supported by a support unit and automatically closed during closing operation of the door according to another embodiment of the present disclosure, in which the positions of the support unit and the droop prevention unit shown in FIGS. 6 to 8 are interchanged.
Figure 10:
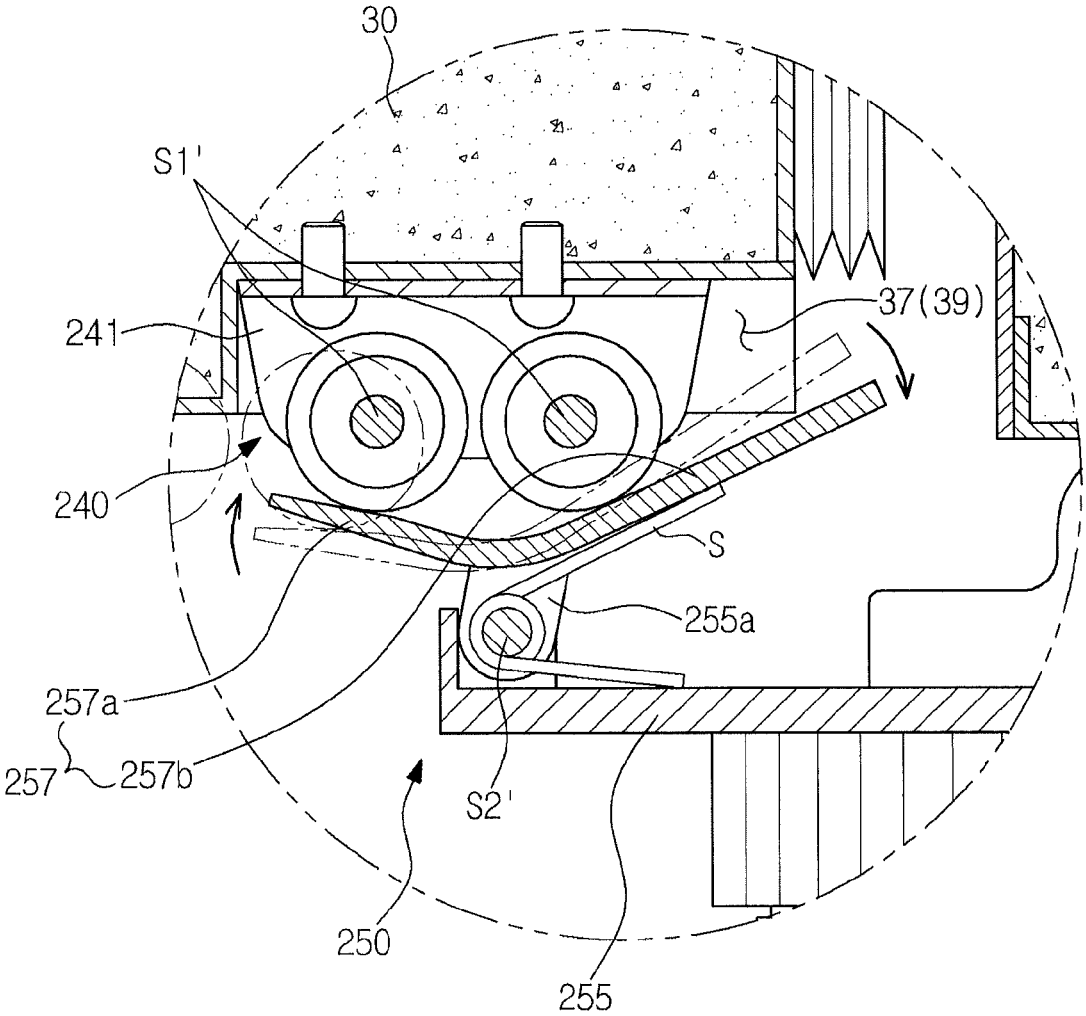
Figure 11:
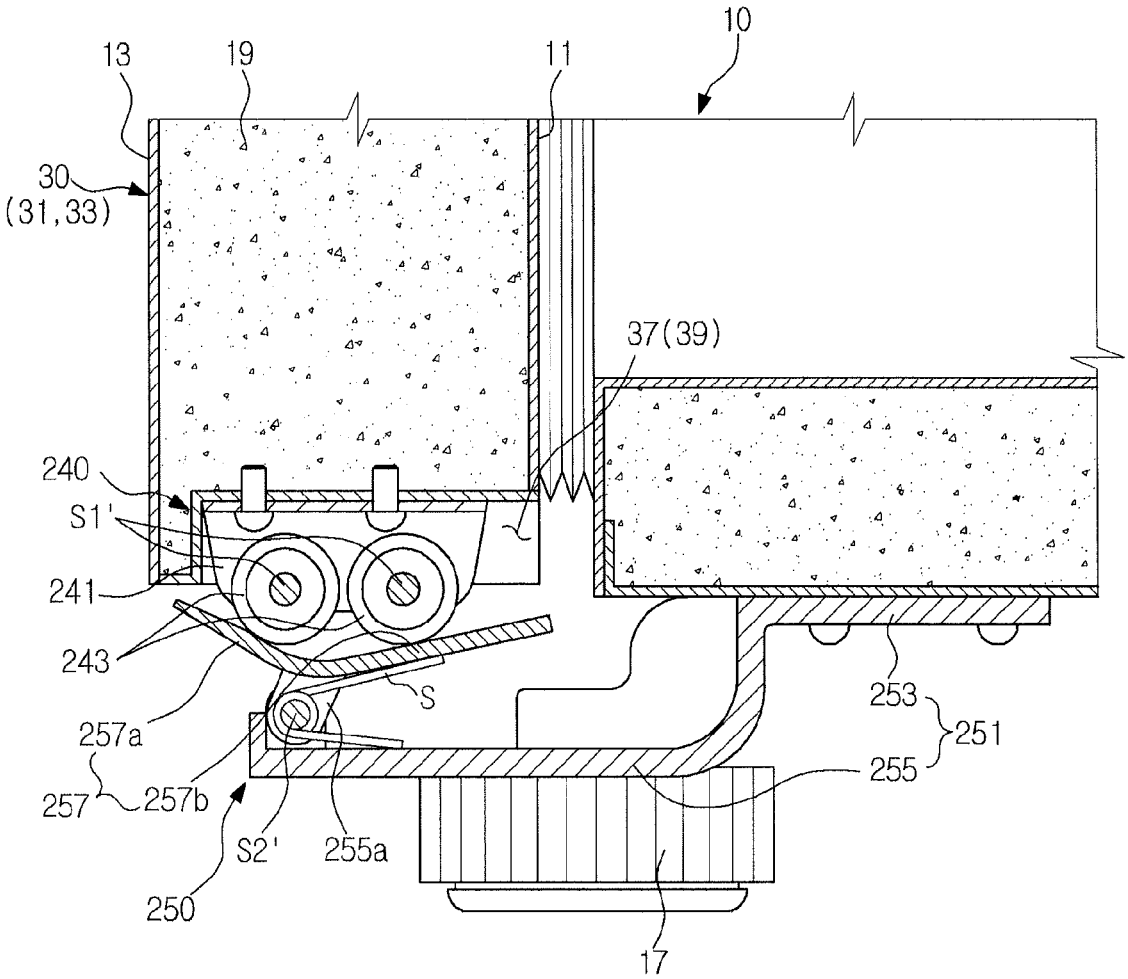

As shown in FIGS. 9 to 11, a support unit 240 including rotating members 243 configured with a plurality of rollers may be coupled to the lower portion of the door 30, and a droop prevention unit 250 including a support 253 may be coupled to the lower portion of the body 10.

The rotating member 243 of the support unit 240 is configured with a plurality of rollers. The support unit 240 includes a housing 241 coupled to coupling grooves 37 and 39 provided at the lower portion of the door 30, and the rotating member 243 rotatably coupled to the housing 241.

The rotating member 243 is configured with a plurality of rollers and is rotatably coupled to the housing 241 by the first rotation shaft S1'.

The droop prevention unit 250 includes a frame 251 including a first frame 253 coupled to the lower portion of the body 10 and a second frame 255 extending from the first frame 253 to the front of the body 10, and a support 257 rotatably coupled to the second frame 255.

The second frame 255 is provided with a coupling portion 255*a* to couple the support 257. The support 257 is rotatably coupled to the coupling portion 255*a* by the second rotation shaft S2'.

The support 257 includes a first support 257*a* positioned at the front portion of the second rotation shaft S2', and a second support 257*b* positioned at the rear portion of the second rotation shaft S2'. An elastic member, for example a spring S is installed at the second rotation shaft S2' to allow the support 257 to remain fixed before contacting the rotating member 243 and to slide and rotate on the rotating member 243 by cooperating with the rotating member 243 only upon contacting the rotating member 243.

As the door 30 is closed, the support unit 240 coupled to the lower portion of the door 30 is supported by the droop prevention unit 250 coupled to the lower portion of the body 10, and thereby the door 30 is prevented from drooping downward. The automatic closing of the door 30 is performed as follows. When the door 30, which is in the open state, is closed as shown in FIG. 9, the rotating member 243 of the support unit 240 coupled to the lower portion of the door 30 comes into contact with the first support 257*a* of the droop prevention unit 250 coupled to the lower portion of the body 10, as shown in FIG. 10.

Once the rotating member 243 contacts the first support 257*a*, the door 30 continues to move in the closing direction, and therefore the rotating member 243 rotates clockwise and moves along the upper surface of the support 257 while contacting the support 257.

When the rotating member 243 moves along the upper surface of the support 257, the support 257 rotates clockwise. Once the door 30 is completely closed as shown in FIG. 11, the rotating member 243 is supported by both the first support 257*a* and the second support 257*b*, and thus the door 30 moves upward a distance corresponding to the amount of drooping. Accordingly, the door 30 drooping downward due to load is returned to and maintained at the horizontal position when the door 30 is closed, and thereby exterior aesthetics of and sealing of the door 30 may be improved.

In addition, as shown in FIGS. 10 and 11, when the door 30 is closed, the support 257 is rotated clockwise by the rotating member 243 which rotates while contacting the first support 257*a* and moving in the closing direction of the door 30. Accordingly, the second support 257*b* moves downward and the rotating member 243 moving along the upper surface of the support 257 moves from the first support 257*a* toward the second support 257*b*.

Therefore, the door 30 may be automatically closed by the force of the rotating member 243 moving along the upper surface of the support 257.

Figure 12:
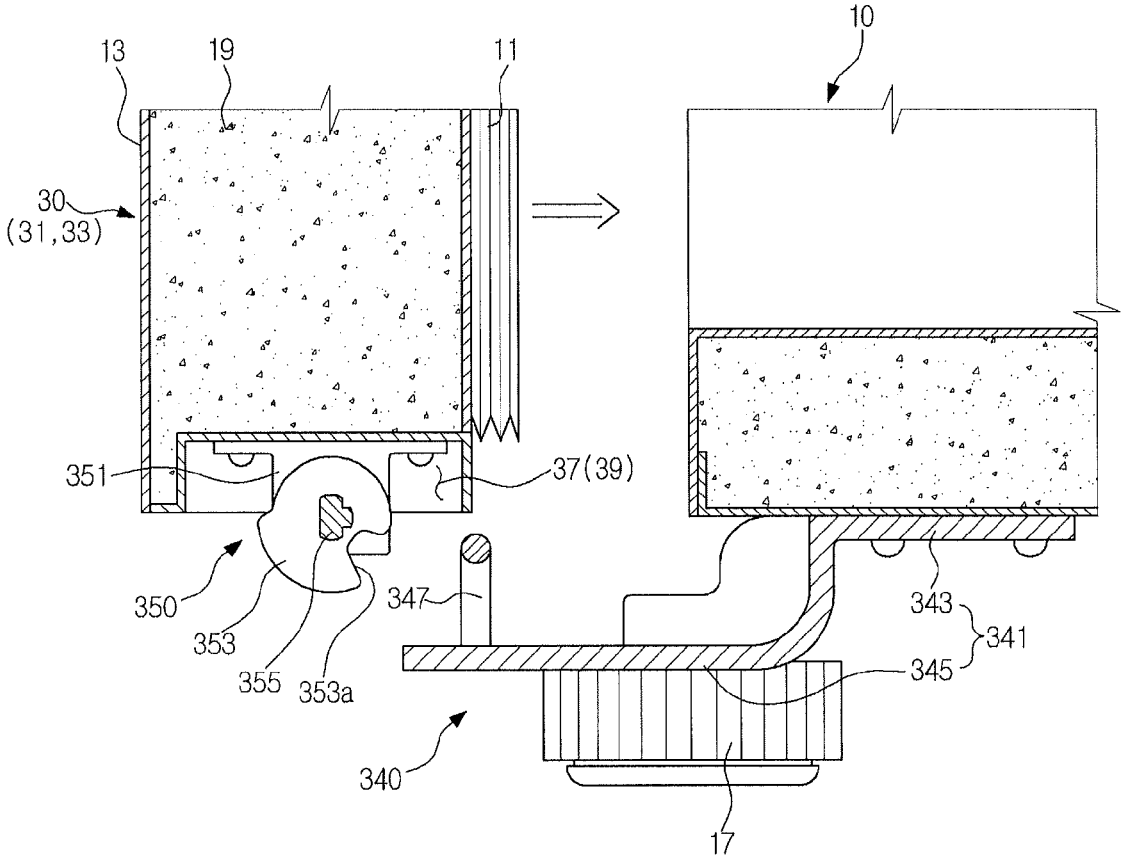
FIGS. 12 to 14 are views illustrating a door supported by a support unit and automatically closed during closing operation of the door according to another embodiment of the present disclosure.
Figure 13:
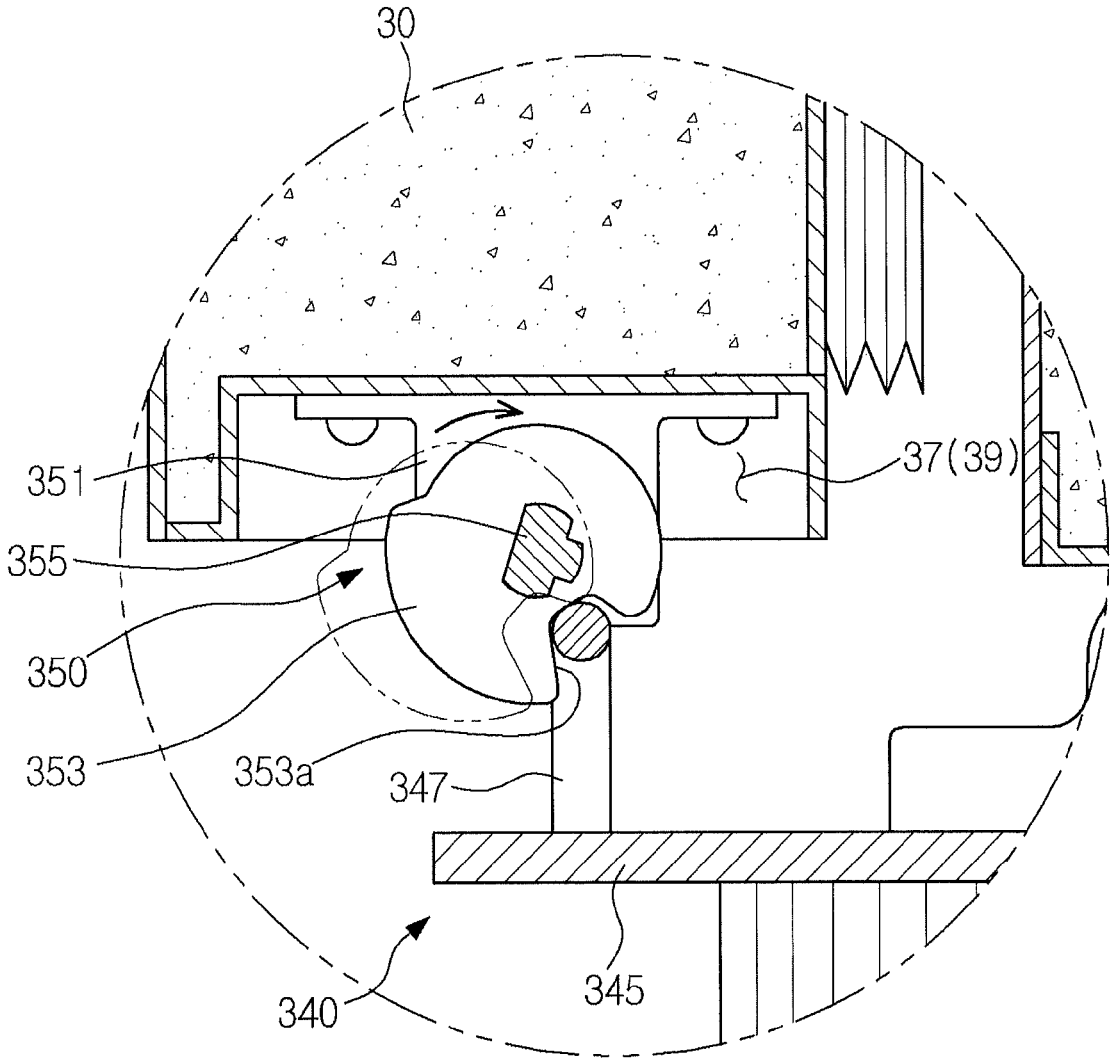
Figure 14:
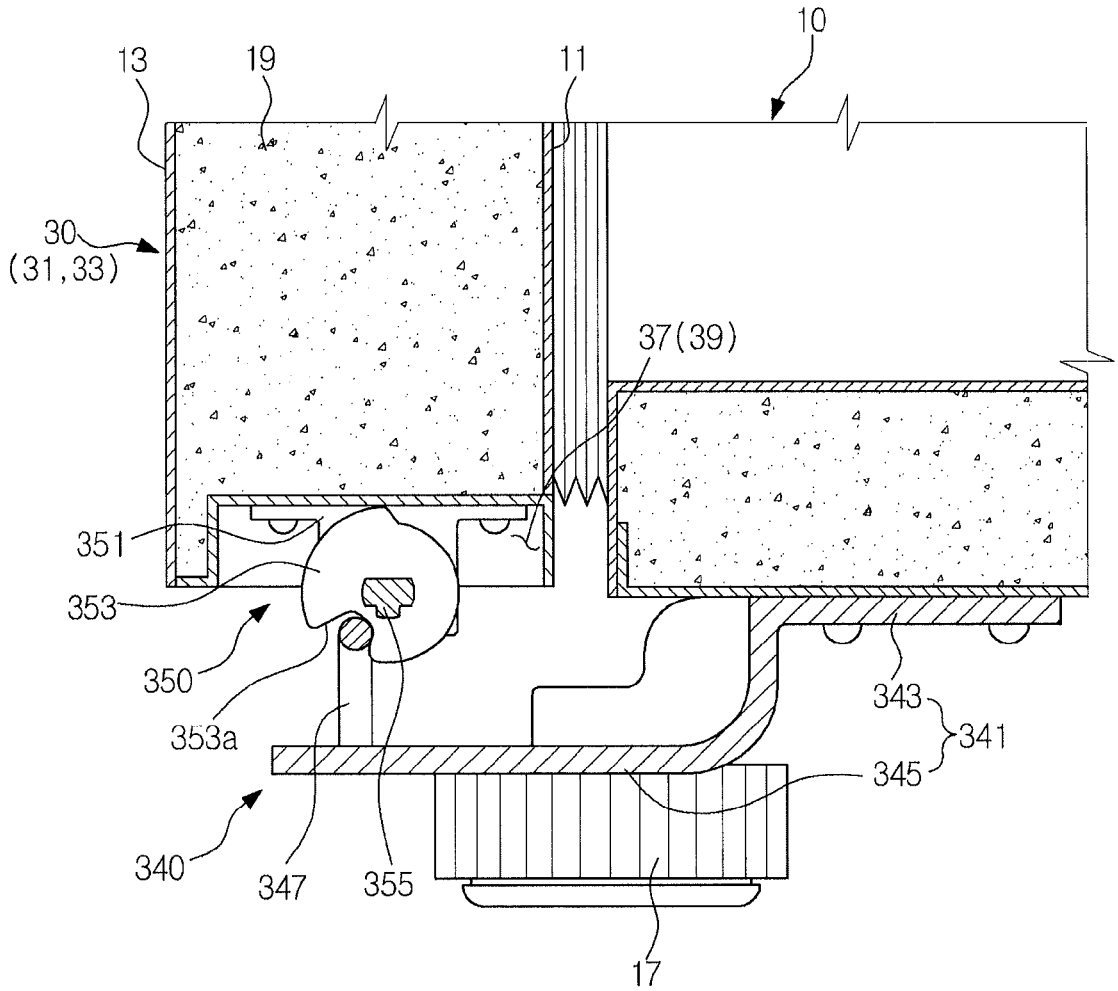

As shown in FIGS. 12 to 14, a support unit 340 may be coupled to the lower central portion of the body 10, and a droop prevention unit 350 may be coupled to the lower portion of the door 30.

The support unit 340 includes a frame 341 coupled to the lower portion of the body 10, and a strut 347 provided at the frame 341.

The frame 341 includes a first frame 343 coupled to the lower portion of the body 10, and a second frame 345 extending forward from the first frame 343 to be exposed to the outside of the front of the body 10.

The second frame 345 is adapted to protrude from the front of the body 10 to correspond to the position of the lower portion of the door 30. The strut 347 provided at the second frame 345 supports the lower portion of the door 30 to prevent the door 30 from drooping downward.

The droop prevention unit 350 is coupled to the lower portion of the door 30 at a position corresponding to that of the support unit 340 to prevent the door 30 from drooping. To allow the droop prevention unit 350 to be coupled, the lower portions of the refrigeration compartment door 31 and the freezer compartment door 33 are respectively provided with the coupling grooves 37 and 39. The coupling grooves 37 and 39 are arranged to allow a part of the droop prevention unit 350 to be accommodated and coupled therein.

The droop prevention unit 350 includes a housing 351 accommodated in and coupled to the coupling grooves 37 and 39, and a support 353 rotatably coupled to the housing 351.

The support 353 is fixed to a rotation shaft 355 rotatably coupled to the housing 351 to rotate together with the rotation shaft 355.

The support 353 is provided with a holding groove 353*a* to accommodate and hold the strut 347 of the support unit 340 during closing of the door 30.

The rotation shaft 355 rotatably coupled to the housing 351 is provided with a cam (not shown). Thereby, when the strut 347 is accommodated and held in the holding groove 353*a* provided at the support 353, the cam operates to rotate the rotation shaft 355 clockwise.

When the strut 347 is accommodated and held in the holding groove 353*a* provided at the support 353 during closing of the door 30, the rotation shaft 355 and the support 353 are simultaneously rotated clockwise by operation of the cam, and thereby the door 30 is automatically closed. As the support 353 is supported by the strut 347, the door 30 may be prevented from drooping downward.

Figure 15:
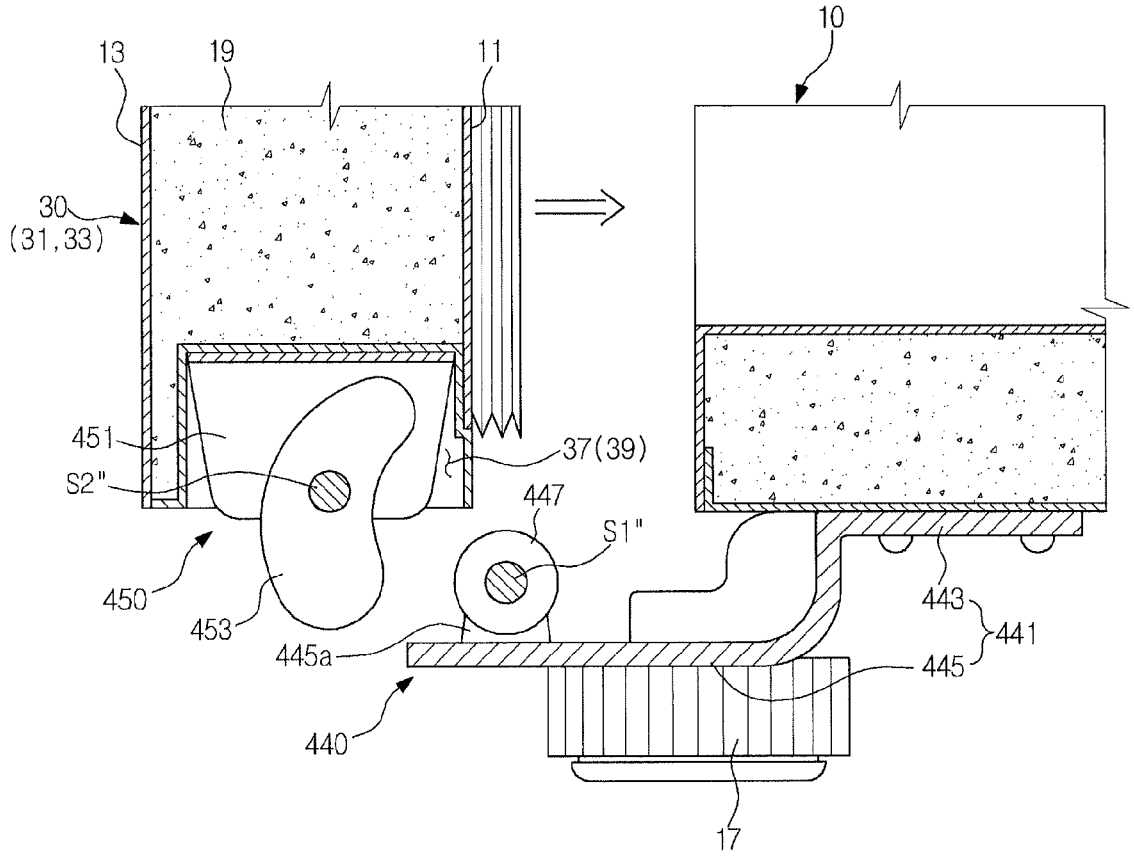
FIGS. 15 to 17 are views illustrating a door supported by a support unit and automatically closed during closing operation of the door according to another embodiment of the present disclosure.
Figure 16:
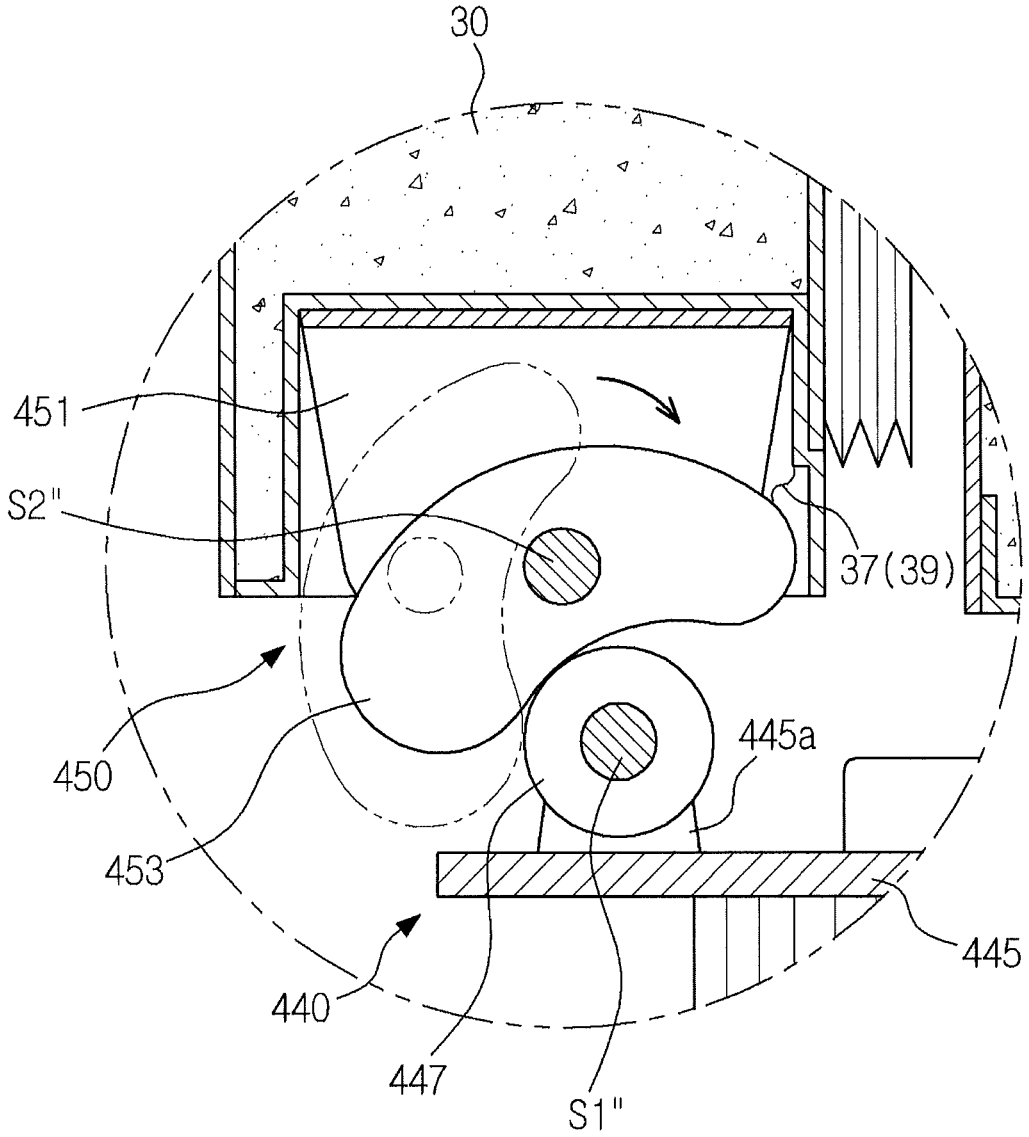
Figure 17:
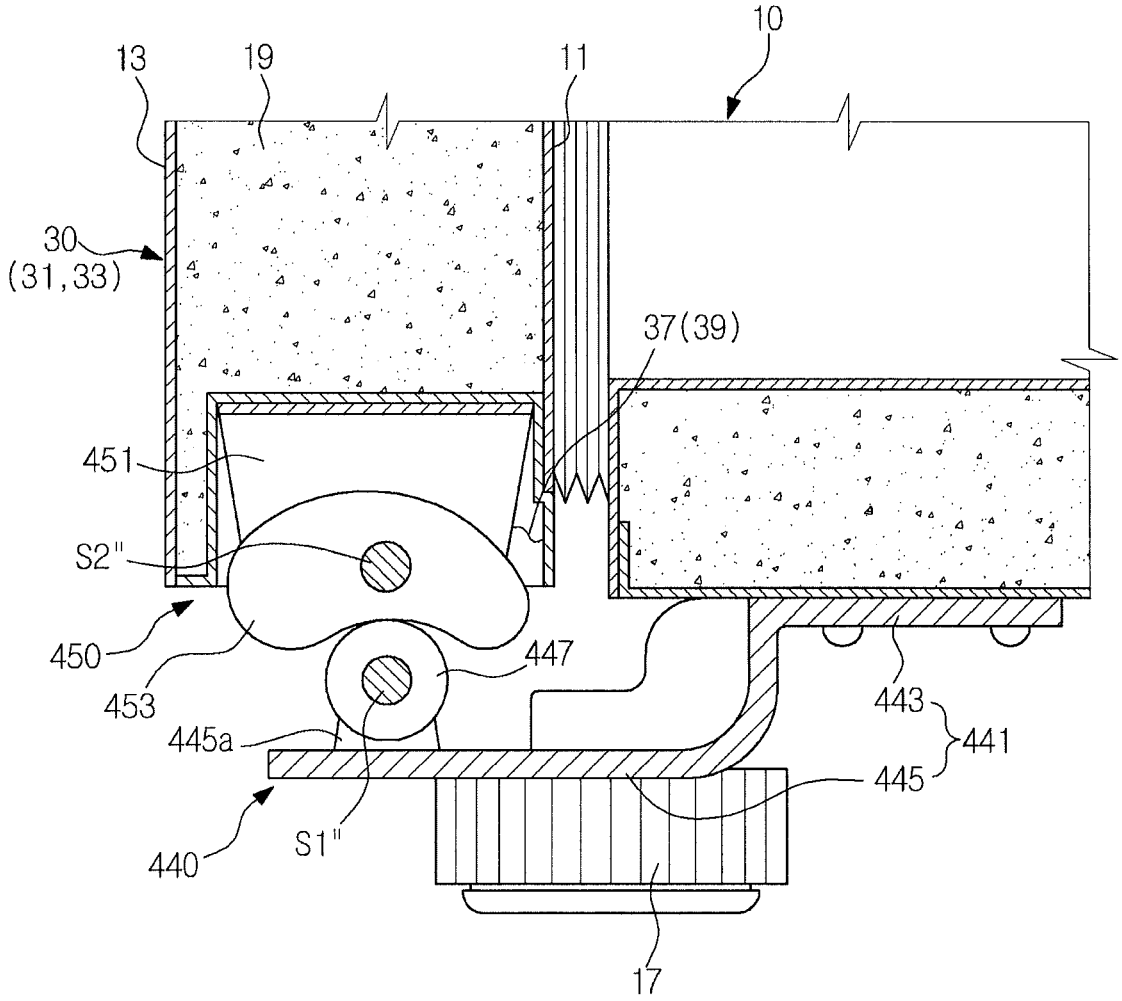

As shown in FIGS. 15 to 17, a support unit 440 may be coupled to the lower central portion of the body 10, and a droop prevention unit 450 may be coupled to the lower portion of the door 30.

The support unit 440 includes a frame 441 coupled to the lower portion of the body 10, and a circular rotating member 447 rotatably coupled to the frame 441.

The frame 441 includes a first frame 443 coupled to the lower portion of the body 10, and a second frame 445 extending forward from the first frame 443 to be exposed to the outside of the front of the body 10.

The second frame 445 is adapted to protrude from the front of the body 10 to correspond to the position of the lower portion of the door 30. The rotating member 447 coupled to the second frame 445 supports the lower portion of the door 30 to prevent the door 30 from drooping downward.

A coupling portion 445*a* to which the rotating member 447 is coupled is provided at the upper portion of the second frame 445. To provide a space allowing the rotating member 447 to be accommodated and coupled therein, the second frame 445 is arranged lower than the first frame 443 by the space in which the rotating member 447 is accommodated.

The rotating member 447 is rotatably coupled to the coupling portion 445*a* by a first rotation shaft S1". The rotating member 447 supports the droop prevention unit 450 coupled to the lower portion of the door 30 to prevent the door 30 from drooping downward.

The droop prevention unit 450 is coupled to the lower portion of the door 30 at a position corresponding to that of the support unit 440 to prevent the door 30 from drooping downward. To allow coupling of the droop prevention unit 450, the lower portions of the refrigeration compartment door 31 and the freezer compartment door 33 are respectively provided with coupling grooves 37 and 39. The coupling grooves 37 and 39 are arranged to allow a part of the droop prevention unit 450 to be accommodated and coupled therein.

The droop prevention unit 450 includes a housing 451 accommodated in and coupled to the coupling grooves 37 and 39, and a support 453 rotatably coupled to the housing 451 by the second rotation shaft S2".

The second rotation shaft S2" rotatably coupled to the housing 451 is provided with a cam (not shown). Thereby, when the support 453 contacts the rotating member 447, the cam operates to rotate the second rotation shaft S2" clockwise.

When one side portion of the support 453 contacts the rotating member 447 during closing of the door 30, the second rotation shaft S2" and the support 453 are rotated together clockwise by operation of the cam, and thereby the door 30 is automatically closed. As the support 453 is supported by the rotating member 447, the door 30 may be prevented from drooping downward.

As is apparent from the above description, drooping of a door may be prevented, and exterior aesthetics and sealing of the inside may be improved. In addition, automatic closing of the door may be implemented with a simple configuration.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body;

a storage compartment provided in the body, a front portion thereof being open;

at least one door rotatably coupled to the body to open and close the storage compartment;

a support unit coupled to a center portion of a lower portion of the body, the support unit including at least one rotating member arranged to protrude from a front portion of the body to correspond to a position of a lower portion of the at least one door; and at least one droop prevention unit coupled to the lower portion of the at least one door at a position corresponding to the at least one rotating member, and supported by the at least one rotating member to prevent the at least one door from drooping downward, the at least one door droop prevention unit cooperating with the at least one rotating member to support the at least one door in an upward direction when the at least one door is closed, wherein the at least one droop prevention unit arranged to transfer force produced by the at least one droop prevention unit, which cooperates with the at least one rotating member, to the at least one door in the moving direction of the at least one door when the at least one door is opened and closed, wherein the at least one droop prevention unit comprises:

a housing provided at the lower portion of the at least one door; and a support rotatably coupled to the housing, and configured not to be moved before contacting the at least one rotating member, and when contacting the at least one rotating member, slide from an upper portion of the at least one rotating member in a closing direction of the at least one door and rotate in cooperation with the at least one rotating member.

2. The refrigerator according to claim 1, wherein the at least one door comprises a refrigeration compartment door and a freezer compartment door, wherein the at least one droop prevention unit is coupled to lower portions of the refrigeration compartment door and the freezer compartment door at positions corresponding to the at least one rotating member.

3. The refrigerator according to claim 2, wherein a number of the at least one rotating members corresponds to a number of the at least one droop prevention unit.

4. The refrigerator according to claim 3, wherein the support unit comprises a frame coupled to the body, the at least one rotating member rotatably coupled to the frame, and a cover to cover an upper portion of the frame.

5. The refrigerator according to claim 4, wherein the frame comprises a first frame member coupled to the lower portion of the body, and a second frame member extending forward from the first frame member to be exposed outside of the front portion of the body, wherein the at least one rotating member is arranged at the second frame member.

6. The refrigerator according to claim 5, wherein the second frame member is provided with a coupling portion to which the at least one rotating member is coupled, wherein the at least one rotating member and the coupling portion are provided with a first rotation hole at positions corresponding to each other such that the at least one rotating member is coupled, via a first rotation shaft inserted in the first rotation hole, to the coupling portion to be rotatable about the first rotation shaft.

7. The refrigerator according to claim 6, wherein the cover is arranged to cover an upper portion of the second frame member and is provided with an opening allowing an upper portion of the at least one rotating member to be exposed outside of the cover.

8. The refrigerator according to claim 3, wherein each of the lower portions of the refrigeration compartment door and the freezer compartment door is provided with a coupling groove allowing a part of the at least one droop prevention unit to be accommodated therein and coupled.

9. The refrigerator according to claim 8, wherein a part of the housing being accommodated in and coupled to the coupling groove.

10. The refrigerator according to claim 9, wherein the housing and the support are provided with a second rotation hole at positions corresponding to each other such that the support is coupled, by a second rotation shaft inserted in the second rotation hole, to the housing to be rotatable about the second rotation shaft.

11. The refrigerator according to claim 10, wherein an elastic member is installed at the second rotation shaft to allow the support maintained in a fixed state to slide on the at least one rotating member in a closing direction of the at least one door and rotate along with the at least one rotating member when the support contacts the at least one rotating member.

12. The refrigerator according to claim 11, wherein force of the support sliding into the closing direction of the at least one door is transferred to the at least one door when the at least one door is closed and force of the support sliding into an opening direction of the at least one door is transferred to the at least one door when the a least one door is opened.

13. The refrigerator according to claim 12, wherein a lower portion of the housing is shaped to be open to allow the support to contact the at least one rotating member.

14. The refrigerator according to claim 13, wherein the support comprises a first support provided at a front portion of the second rotation hole into which the second rotation shaft is inserted to contact the at least one rotating member when the at least one door is closed, and a second support provided at a rear portion of the second rotation hole to contact the at least one rotating member and support the at least one door together with the first support when the support rotates along with the at least one rotating member.

15. A refrigerator comprising:

a body;

a storage compartment provided in the body, a front portion thereof being open;

at least one door rotatably coupled to the body to open and close the storage compartment, the at least one door comprising a refrigeration compartment door and a freezer compartment door;

a support unit coupled to a lower portion of the body to protrude from a front portion of the body to support the at least one door; and at least one droop prevention unit coupled to each of lower portions of the refrigeration compartment door and the freezer compartment door to be supported by the support unit to prevent the freezer compartment door and the refrigeration compartment door from drooping downward, wherein the at least one droop prevention unit arranged to transfer force produced by sliding of the at least one droop prevention unit which cooperates with the support unit to the at least one door in the moving direction of the at least one door when the at least one door is opened and closed, the support unit is coupled to a center of the lower portion of the body, and comprises a frame coupled to the body and a plurality of rotating members rotatably coupled to the frame, wherein the at least one droop prevention unit comprises:

a housing provided at a lower portion of the at least one door; and a support rotatably coupled to the housing, and configured not to be moved before contacting the plurality of rotating members, and when contacting the plurality of rotating members, slide from an upper portion of the plurality of rotating members in a closing direction of the at least one door and rotate in cooperation with the plurality of rotating members.

16. The refrigerator according to claim 15, wherein the support unit comprises a cover to cover an upper portion of the frame.

17. The refrigerator according to claim 16, wherein the frame comprises a first frame member coupled to the lower portion of the body, and a second frame member extending forward from the first frame member to be exposed outside of the front portion of the body, wherein the plurality of rotating members are arranged at the second frame member.

18. The refrigerator according to claim 17, wherein the second frame member is provided with a coupling portion to which the plurality of rotating members are coupled, wherein the plurality of rotating members and the coupling portion are provided with a first rotation hole at positions corresponding to each other such that the plurality of rotating members are coupled, via a first rotation shaft inserted in the first rotation hole, to the coupling portion to be rotatable about the first rotation shaft.

19. The refrigerator according to claim 18, wherein the cover is arranged to cover an upper portion of the second frame member, and is provided with an opening allowing upper portions of the plurality of rotating members to be exposed outside of the cover.

20. The refrigerator according to claim 19, wherein each of the lower portions of the refrigeration compartment door and the freezer compartment door is provided with a coupling groove allowing a part of the at least one droop prevention unit to be accommodated therein and coupled.

21. The refrigerator according to claim 20, wherein a part of the housing being accommodated in and coupled to the coupling groove, and the support supported by the plurality of rotating members.

22. The refrigerator according to claim 21, wherein the housing and the support are provided with a second rotation hole at positions corresponding to each other such that the support is coupled, via a second rotation shaft inserted in the second rotation hole, to the housing to be rotatable about the second rotation shaft.

23. The refrigerator according to claim 22, wherein an elastic member is installed at the second rotation shaft to allow the support maintained in a fixed state to slide on the plurality of rotating members in a closing direction of the refrigeration compartment door and the freezer compartment door and rotate along with the plurality of rotating members when the support contacts the plurality of rotating members.

24. The refrigerator according to claim 23, wherein force of the support sliding into the closing direction of the at least one door is transferred to the at least one door when the at least one door is closed and force of the support sliding into an opening directing of the at least one door is transferred to the at least one door when the at least one door is opened.

25. The refrigerator according to claim 24, wherein a lower portion of the housing is shaped to be open to allow the support to contact the plurality of rotating members.

26. The refrigerator according to claim 25, wherein the support comprises a first support provided at a front portion of the second rotation hole into which the second rotation shaft is inserted to contact the plurality of rotating members when the at least one door is closed, and a second support provided at a rear portion of the second rotation hole to contact the plurality of rotating members and support the at least one door together with the first support when the support rotates along with the plurality of rotating members.

* * * * *